US007478916B2

(12) United States Patent
Von Preyss

(10) Patent No.: US 7,478,916 B2
(45) Date of Patent: Jan. 20, 2009

(54) GROUND LIGHTING FIXTURE

(75) Inventor: Thomas Aleksander Henrik Von Preyss, Risskov (DK)

(73) Assignee: Martin Professional A/S, Aarhus N (DK)

( * ) Notice: Subject to any disclaimer, the term of this patent is extended or adjusted under 35 U.S.C. 154(b) by 0 days.

(21) Appl. No.: 10/597,884

(22) PCT Filed: Feb. 3, 2005

(86) PCT No.: PCT/DK2005/000074

§ 371 (c)(1),
(2), (4) Date: Apr. 9, 2007

(87) PCT Pub. No.: WO2005/075886

PCT Pub. Date: Aug. 18, 2005

(65) Prior Publication Data

US 2007/0268705 A1 Nov. 22, 2007

(30) Foreign Application Priority Data

Feb. 10, 2004 (DK) ..... 2004 00197

(51) Int. Cl.
*F21V 33/00* (2006.01)

(52) U.S. Cl. ..... 362/153.1; 362/153; 362/372; 362/293; 362/287; 362/267

(58) Field of Classification Search ..... 362/153, 362/372, 364, 153.1, 145, 223, 296, 293, 362/287, 267
See application file for complete search history.

(56) References Cited

U.S. PATENT DOCUMENTS

| | | | | |
|---|---|---|---|---|
| 5,481,443 | A | 1/1996 | Wagner et al. | |
| 5,522,769 | A * | 6/1996 | DeGuiseppi | 454/270 |
| 5,908,236 | A * | 6/1999 | Lueken et al. | 362/364 |
| 6,547,426 | B1 | 4/2003 | Ebara | |
| 2004/0114355 | A1 * | 6/2004 | Rizkin et al. | 362/153 |

FOREIGN PATENT DOCUMENTS

| | | |
|---|---|---|
| EP | 0 269 323 A1 | 6/1988 |
| WO | WO 00/47932 A1 | 8/2000 |

* cited by examiner

*Primary Examiner*—Laura Tso
(74) *Attorney, Agent, or Firm*—David S. Safran; Roberts Mlotkowski Safran & Cole, P.C.

(57) ABSTRACT

An apparatus for illumination having a housing suited for in ground use, which contains at least one lamp which is surrounded by a reflector, a controller for controlling the lamp and light changing means. To reduce the content of moisture, air containing evaporated water is able to be released from the lamp to the surroundings and only air without moisture is allowed to enter the in-ground lamp.

10 Claims, 6 Drawing Sheets

GROUND LIGHTING FIXTURE

BACKGROUND OF THE INVENTION

1. Field of the Invention

The present invention relates to an apparatus for illumination comprising at least one housing suited for in ground use, which housing might contain at least one lamp, which lamp can be surrounded by reflective means, which housing further can comprise light changing means, which housing also can comprise control means for controlling at least the lamp and the light changing means.

The present invention also relates to a method for preventing moisture build-up inside an apparatus for illumination, which apparatus contains at least one lamp, which lamp is surrounded by reflective means which apparatus is communicating with control means for controlling at least the lamp.

2. Description of Related Art

U.S. Pat. No. 6,210,014 describes a material and a system for reducing condensation in enclosed vehicle lamp housings, and more particularly a condensation vent comprising a water vapor material within, on or integrated with the housing to reduce the condensation and prevent or minimize entry of liquid water and/or other foreign matter.

U.S. Pat. No. 6,210,014 describes a lamp used in a car where an opening in the upper par of the lamp is covered by a diaphragm for venting the lamp. Inside the car, the car itself protects the venting opening so that no mechanical damage occurs to the diaphragm. Using an upwards pointing diaphragm for in ground use will be completely impossible because in ground devices are subjected to the outdoor environment. In ground installations could often be placed where people are walking or even where cars are driving. This means, that a diaphragm would be subjected to pressure, which would destroy the diaphragm immediately. At least, a kind of mechanical protection is necessary. The diaphragm must be protected from being overflowed because the diaphragm is tight for water from the outside, in the overflowed situation, it will also be tight for water from the inside. In this way, the technology described in U.S. Pat. No. 6,210,014 could not be used for an in ground installation.

U.S. Pat. No. 6,540,374 describes an in ground lighting fixture having multiple separate and watertight compartments for the various components of the fixture, allowing for maintenance and service of the fixture without exposing weather-sensitive components to the elements. The fixture also includes a pan and tilt assembly, which can be selectively controlled with a common household tool to change the direction of the light without having to access the pan and tilt assembly.

U.S. Pat. No. 6,540,374 describes a water tight compartment for in ground use, but the document does not describe any effective ventilation means, which may lead to the fact that water inside the in ground lighting fixture will condensate on the inner side of the outside surfaces including the top window which is visible from the outside. During operation, the temperature inside the lighting fixture will increase, and the water inside will evaporate. An increasing pressure will probably press part of the moisture out through openings, but as soon as the lamp is shut off, the temperature drops which leads to a pressure reduction inside the in ground lighting fixture, and probably at least over time, air with a high moisture content is sucked back to the inside of the in ground lighting fixture. The reduced pressure inside the lamp housing could lead to a flow of water through the connecting cables. The cables might be placed deeper in the ground than the lamp and the cables might be surrounded by water. A reduced pressure in one end of a cable starts a pumping effect, which can lead to an inflow of water into the lamb housing.

SUMMARY OF THE INVENTION

The scope of the invention is to reduce the content of moisture in an in ground lamp by allowing air with a content of evaporated water to be released from the lamp to the surroundings and only allow air without moisture to enter the in ground lamp.

This can be achieved by a housing comprising an outer casing which casing might comprise at least one diaphragm covering at least one opening in the casing which diaphragm might be permeable for moisture for transmission from the inside of the housing to the outside, and that is water tight from the outside.

Hereby, it is achieved that the volume inside the housing is vented through the diaphragm. Each time the lamp is turned on the inside temperature, the pressure in the housing increases. If there is moisture content in the housing, the increasing temperature will cause the moisture to evaporate, and air containing moisture penetrates the diaphragm. After a shut down, the temperature and pressure inside the housing decrease. Air with a low content of moisture penetrates the diaphragm and the pressure inside the housing is mostly equal to the atmosphere pressure. This way, suction of water through small openings in the casing or through cables is avoided. By keeping the housing dry moisture build-up in the top window is avoided. Also the different components in the housing have a longer lifetime in the dry atmosphere.

The opening in the casing might be placed in the lower part of the casing and directed downwards. Hereby, protection of the diaphragm from the harsh environment above the apparatus is achieved. The diaphragm is also protected from being covered by ice and/or snow, and if the apparatus as such is overflowed, there will probably be an air pocket at least partly below the apparatus around the diaphragm. This apparatus can operate normally in nearly all environments. Even in a situation where the apparatus is completely overflowed, the diaphragm is as such protected from water penetrating from the outside. As soon as the apparatus is in operation, increasing pressure will force air from the inside through the diaphragm out in the surrounding water where bubbles are formed. Depending on the shape of the apparatus, the bubble can be maintained just under the apparatus until the apparatus is turned off where air with a very low moisture content is allowed to penetrate the diaphragm, and the bubble on the outside is reduced.

The opening in the casing might, as an alternative, be placed in the lower part of the casing in a vertical direction. Hereby, it is achieved that drops of water on the outside of the diaphragm is pulled downwards by gravity to keep the diaphragm open.

The apparatus might comprise at least changeable means for forming the light beam. Hereby, it is achieved that different light forming devices can be used, and they could be changeably based on an inside generated commanding signal or on an outside commanding signals. Hereby, different light effects can be achieved during illumination; even moving means could be used and as such form the movement in the light that is projected onto a target.

The apparatus might also comprise means for colour change of the light beam. Hereby, it is achieved that the colour of the light can be changed. One possible apparatus can contain a colour wheel with different colours stored in that colour wheel, and by rotating the colour wheel based on an internal generated commanding signal or an external generated commanding signal, different colours could be achieved in the projected light. In a modified apparatus the change of colour of the light can take place by electric control of a lamp. Instead of using colour wheels, linear movement of colour filters in and out of the light beam can be used for achieving sliding changes of colours. The technique of colours changes together with means for forming the light beam, can give a lot of different effects which can be achieved as the two techniques can be used in combination.

The apparatus might comprise controllable means for pan and tilt of the light beam. Hereby, it is achieved that the direction of the light can be changed into different directions. In an in ground lighting fixture, there is a limited angle for pan or tilt in all directions because the movement of the lamp unit has to take place inside a housing. Changing of pan or tilt could be made mechanically such that the lamp is adjusted once, but in another possible apparatus, the pan and tilt of the lamp could be done by servo motors controlled from the apparatus or from the outside by a commanding signal. In this way, the direction of the light could be movable during operation.

The apparatus can be divided into a first section and a second section, which first section contains the lamp chamber, and the second section contains electric power components and a control circuits for control of the lamp and/or servo motors, which second section contains power and data connections. Hereby, it is achieved that the temperature from the lamp has a limited influence on the temperature of the electronic components.

The first section of the housing might comprise a lamp chamber having a bottom wall, below which bottom wall the second section of the housing can be placed in which a number of separate chambers are formed, where a first chamber can contain electronic power components, where a second smaller chamber can contain control circuits for controlling servo motors for adjustment of shape and/or colour and/or pan and/or tilt, where a third chamber can contain power connections, and where a fourth chamber can contain data connections. Hereby, it is achieved that different components are placed in different chambers where negative influence from some parts of the components to other parts of the components in this way is reduced. Placing the lamp in a separate chamber allows this chamber to be heated up to a certain extent without high temperatures having any direct influence on the electronic components, which are placed in separate chambers below. By placing the different electronic components in different chambers, the same effect occurs, in that for example, the power components are all placed in one chamber in which chamber, the temperature can increase to a higher level than in the second chamber where all control circuits are placed. The heating that occurs in the first and the second chamber can widely be transmitted to the surroundings through walls of the housing to the surrounding environment. It is possible to let a small opening from the first and second chamber to be opened towards the lamp chamber placed above it. In this way, moisture from the two chambers can enter the lamp chamber where most of the moisture due to the higher temperature probably is contained as moisture in the air and as such be led out through the diaphragm to the environment.

The lamb chamber and the first and the second chambers are open to the flow of air, and the lamb chamber is tight towards the third and fourth chambers. Hereby, it is achieved that the third and the fourth chambers are mostly isolated from the rest of the apparatus. This means that moisture, which enters these two chambers, is restricted from getting further into the apparatus. As the third and the fourth chambers are the only chambers, which have cable connections to the surroundings, they are the only chambers where moisture can enter the apparatus. Furthermore, because these two chambers only contain cable connections, the moisture content in these two chambers is mostly uncritical.

The first and second chambers are separated by a cut through, which is open downward to the surroundings, which cut through is open towards the bottom wall of the lamp chamber, where the bottom wall in an area above the cut through contain an opening covered by a diaphragm. Hereby, it is achieved that the opening points downwards without being placed in the lowest part of the apparatus. In this way, it is achieved that under normal conditions, there will always be air around the cut through, and there will be air towards the diaphragm. In this way, it is achieved that the diaphragm will function correctly for a long time period, and even if the apparatus is partly overflowed, the cut through which is placed between the first and the second chamber will probably be kept dry. The cut through between the first and the second chamber also increases the size of the surface of the housing that surrounds the two chambers. Therefore an increase in the total surface able to perform a heat transfer to the surroundings is achieved.

The diaphragm is placed in a diaphragm holder, which diaphragm holder is replaceable in an opening in the bottom wall. Hereby, it is achieved that during maintenance of the apparatus, the diaphragm is replaceable. Even if the diaphragm is rather stable, it can during a long period be filled up with dirt on both the inside and the outside surface, and as the diaphragm as such is a rather cheap component, an exchange only takes very few seconds. Therefore, if there is a normal maintenance of the apparatus where, for example, the lamp is changed, the diaphragm might be changed as well.

In an alternative embodiment of the invention, the first and second sections can be separated, where the second section might be placed beside the first section for achieving access to the second section, where cables can connect the first and the second section. Hereby, it is achieved that there can be easy service access to both houses. Service to the electronic part can be carried out without opening the lamp housing. By placing the second section side by side, the first section reduces the high of the apparatus. Then the apparatus could be used indoors where both sections could be placed under a floor.

The invention also relates to a method comprising the use of permeable means for moisture transmission from the inside of the apparatus to the outside and for transmission of dry air from the outside to the inside.

Hereby, moisture build-up inside an apparatus that operate under outdoor conditions is prevented.

In the following, the invention will be described with reference to the drawings.

DETAILED DESCRIPTION OF THE INVENTION

Figure 1:
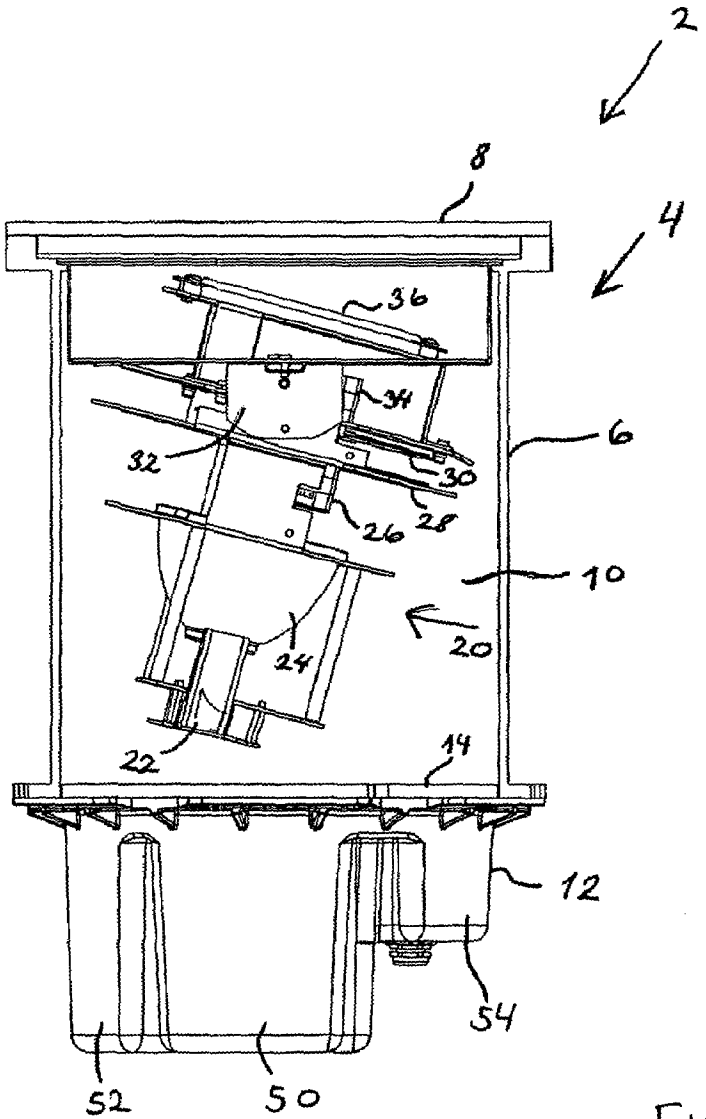
FIG. 1 shows a cut through of a first embodiment of the invention.

FIG. 1 shows an apparatus 2 according to a first embodiment of the invention where the apparatus 2 has a housing 4, which comprises an outer casing 6, a top glass 8 surrounding a lamp chamber 10 where the outer casing 4 further comprises a bottom casing 12. Between the lamp chamber 10 and the bottom casing 12 a bottom wall 14 is placed dividing the housing 4 into an upper part and a lower part. The lamp chamber 10 comprises a lamp unit 20, which contains a lamp socket 22, a reflector 24, optical means 26 and changeable means 28 for forming the shape of the light. Furthermore the light passes through means 30 for colour change of the light where the lamp unit 20 is held in position by means 32 for pan or tilt of the lamp unit 20. The lamp unit 20 further comprises optical means 34 and a glass cover 36. The bottom casing 12 shows different separated chambers: a first chamber 50, a second chamber 52 and a third chamber 54. The chamber 50 contains electric power components, i.e. power transistors for ballast capacitors and coils. The second chamber 52 contains electronic control units for controlling motors for a change of light form or a colour change of the light, or for a change of pan or tilt. The chamber 54 contains cable connections for the apparatus 2.

Figure 2:
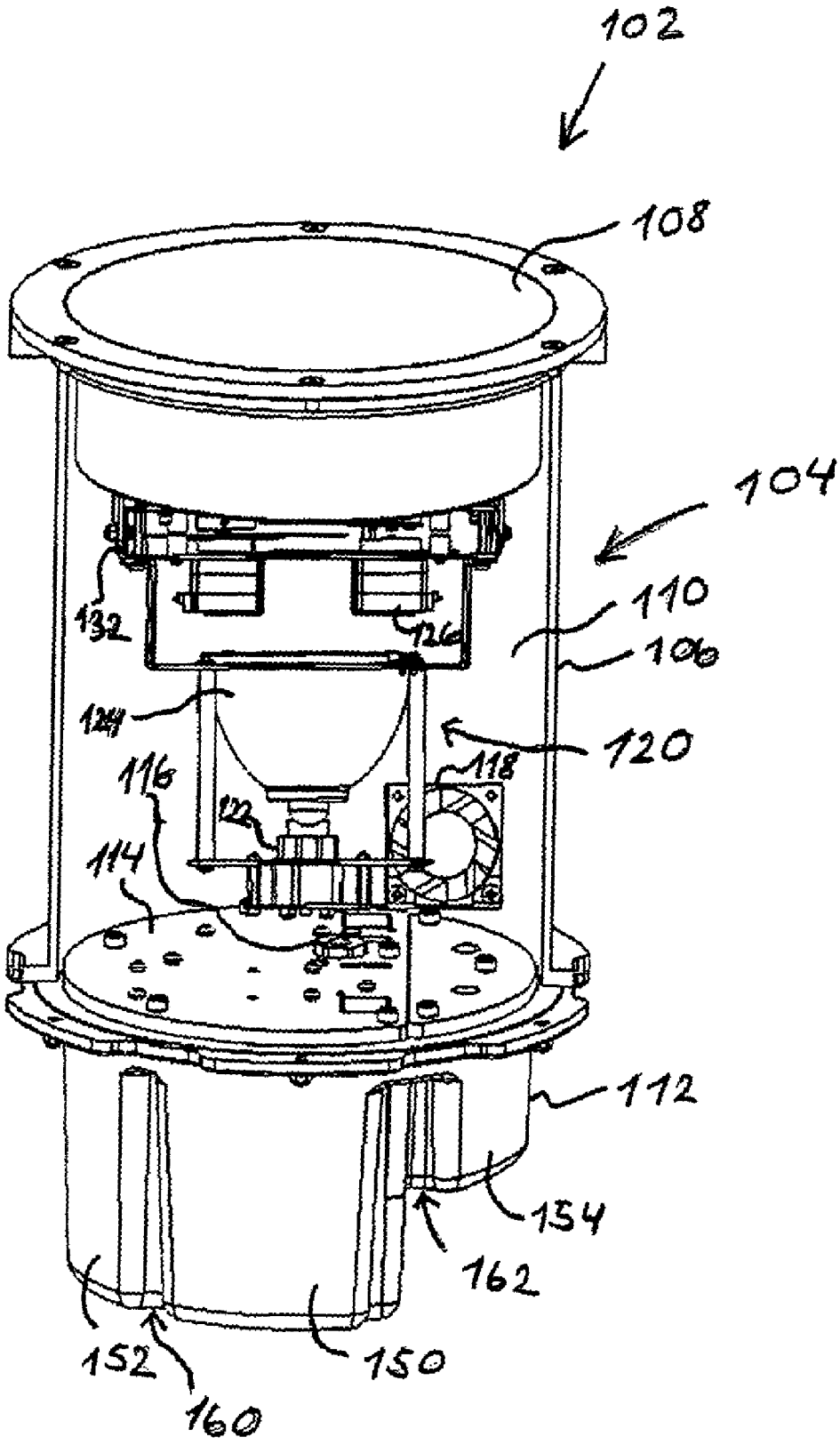
FIG. 2 shows a three-dimensional cut through of a preferred embodiment of the invention.

FIG. 2 shows an apparatus 102 comprising a housing 104, which housing 104 contains an upper casing 106, a top glass 108 defining a lamp chamber 110 and a bottom chamber 112. Between the lamp chamber 110 and the bottom chamber 112, a bottom wall 114 is formed. This bottom wall 114 contains an opening 116 which opening 116 is covered by a not shown diaphragm. Inside the lamp casing 110, a blowing unit 118 is also seen. The casing 110 further comprises a lamp unit 120 comprising a lamp socket 122 and a reflector 124. The tamp unit 120 further comprises optical means 126, and means 132 is shown for pan and tilt of the lamp unit 120. This unit further comprises means for forming the shape of light and also means for colour change. These means are not shown on this figure. Below the lamp chamber 110, the bottom casing 112 is shown. This bottom casing 112 shows a first chamber 150, a second chamber 152 and a third chamber 154. Between the chambers 150 and 152, the cut through 160 is shown. Further between the chamber 150 and the chamber 154, a cut through 162 is shown.

Figure 3:
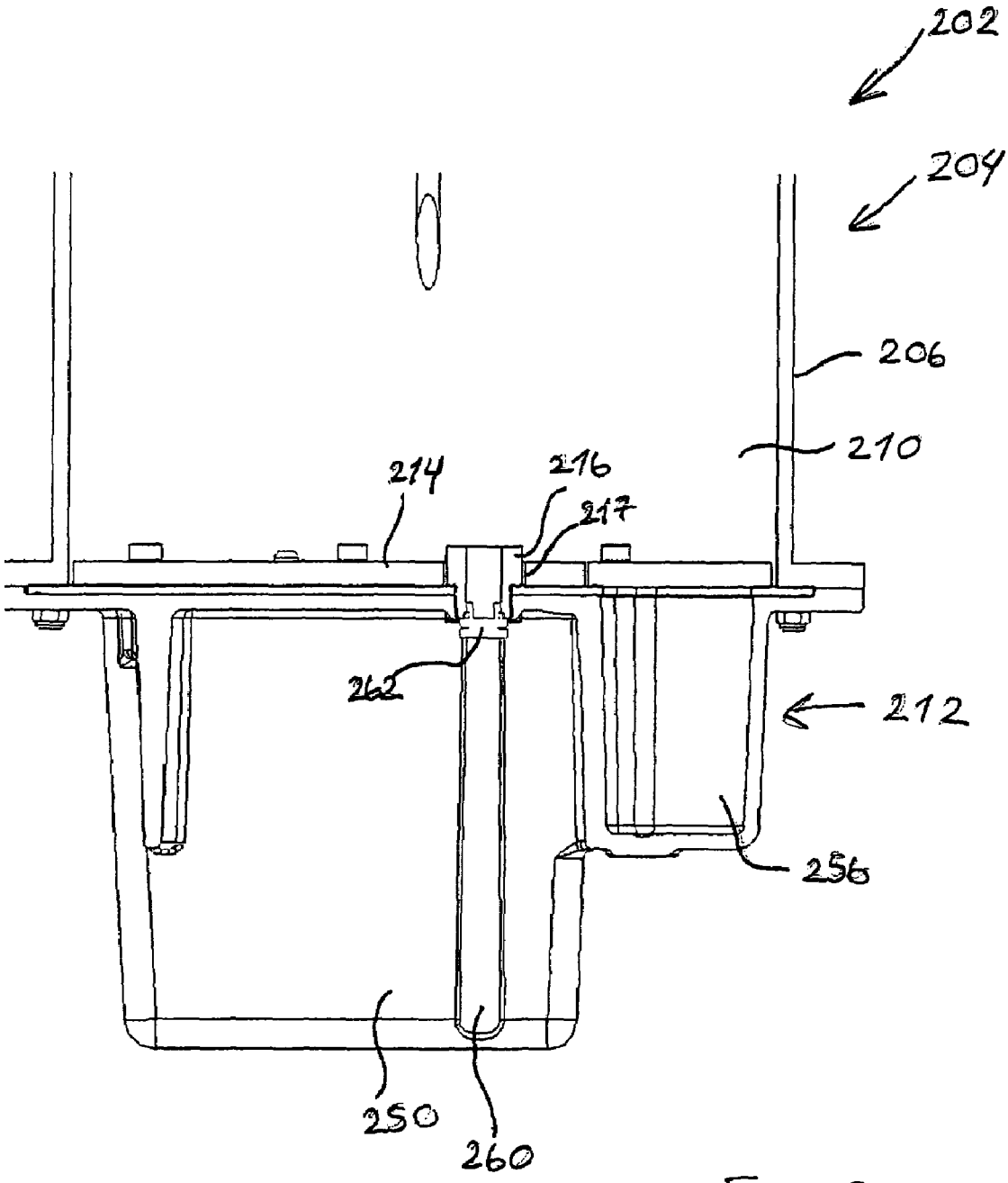
FIG. 3 shows an enlarged cut through seen from a different angle of the bottom of the invention.

FIG. 3 shows parts of the same embodiment as shown in FIG. 2, but the cut through is seen from a different direction. FIG. 3 shows part of an apparatus 202 having a housing 204 with a casing 206 and lamp chamber 210. A bottom casing 212 ends the bottom of the casing. Between the lamp housing 210 and the bottom casing 212, a bottom wall 214 is formed. This bottom wall 214 contains a diaphragm holder 216 placed in a hole 217 which hole penetrates the bottom wall 214 and continues through an upper wall in the bottom casing 212. The diaphragm holder 216 penetrates the holes and ends in the cut through 216. The holding means 216 comprises a diaphragm 262 to allow moisture from the inside of the casing 210 to penetrate the diaphragm 262 and escape through the cut through 260. In the opposite direction from the cut through 260 and into the casing 210, only dry air can penetrate the diaphragm 262.

Figure 4:
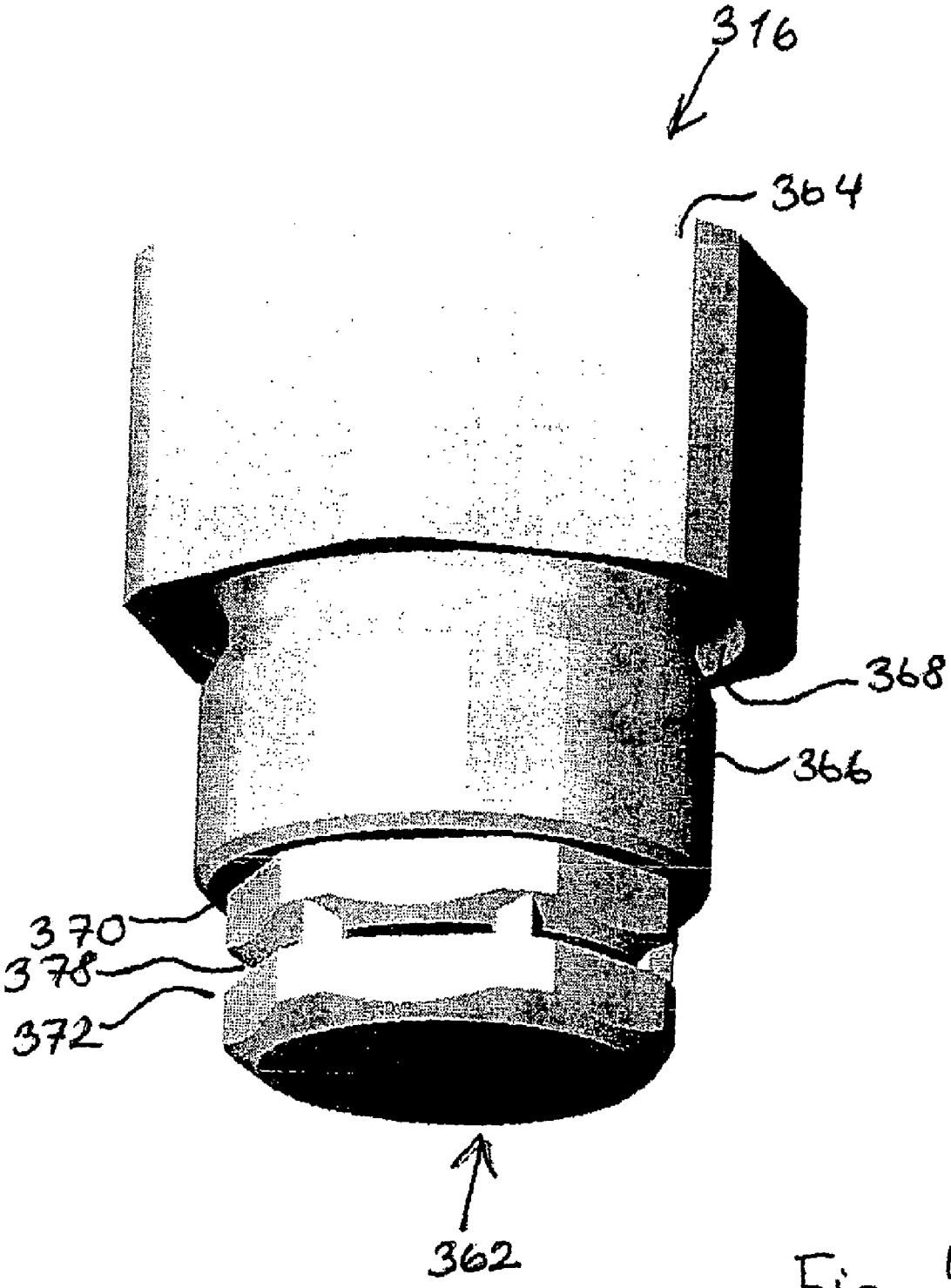
FIG. 4 shows a perspective view of a diaphragm holder.

FIG. 4 shows a diaphragm holder 316, which contains an upper part 364 cooperating with the opening 217 shown at the FIG. 3. Directly below the upper part 364 of the diaphragm holder 316, a partly circular upwards directed recess 368 is shown which might contain an O-ring for tightening against the upper part of the bottom casing 212. The holding means 316 further comprises a cylindrical section 366, which penetrates through the opening in the upper part of the casing 212. At the bottom of the cylindrical part 366, tightening means 370 is seen tightening against the movable part 372 which can be screwed out for replacement of the diaphragm 362. Venting openings 378 are open towards the diaphragm 362.

Figure 5:
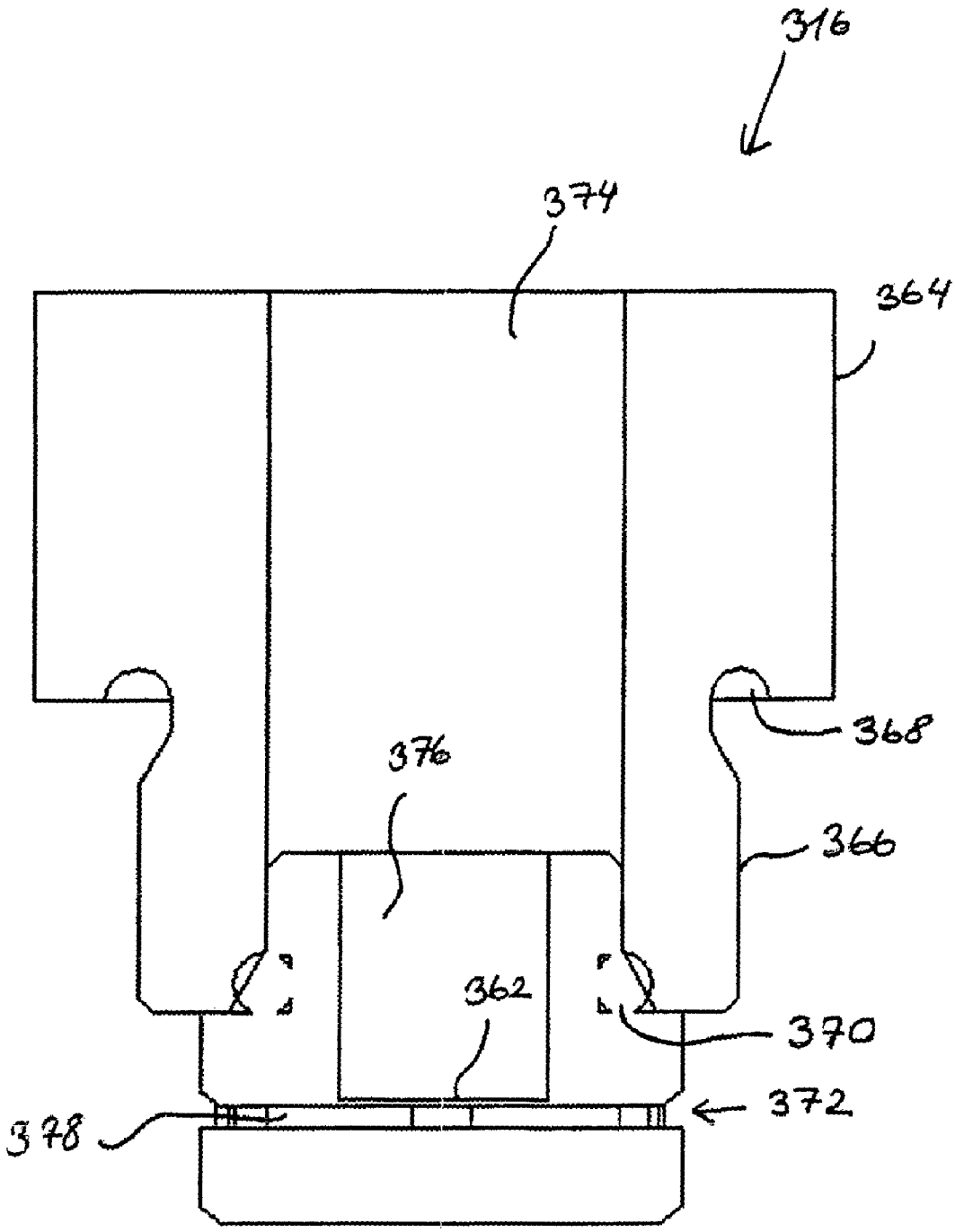
FIG. 5 shows a cut through of the diaphragm holder.

FIG. 5 shows a cut through of the diaphragm holder 316, which is also shown in FIG. 4. The diaphragm holder in FIG. 5 shows an upper part 364, which upper part continues into a cylindrical section 366. The cylindrical surface 366 might be treated so the diaphragm holder could be screwed into a housing. Below the upper part 364, a shoulder and a recess 368 are shown, where the recess 368 is suited for an O-ring that can tighten if the cylindrical part 366 is screwed into a housing. The upper part 364 is connected to a lower part 372, which is screwed into an opening 374 in the upper part. Between the lower part 372 and the upper part 364, an O-ring 370 is seen. The lower part 372 also comprises ventilation openings 378.

Figure 6:
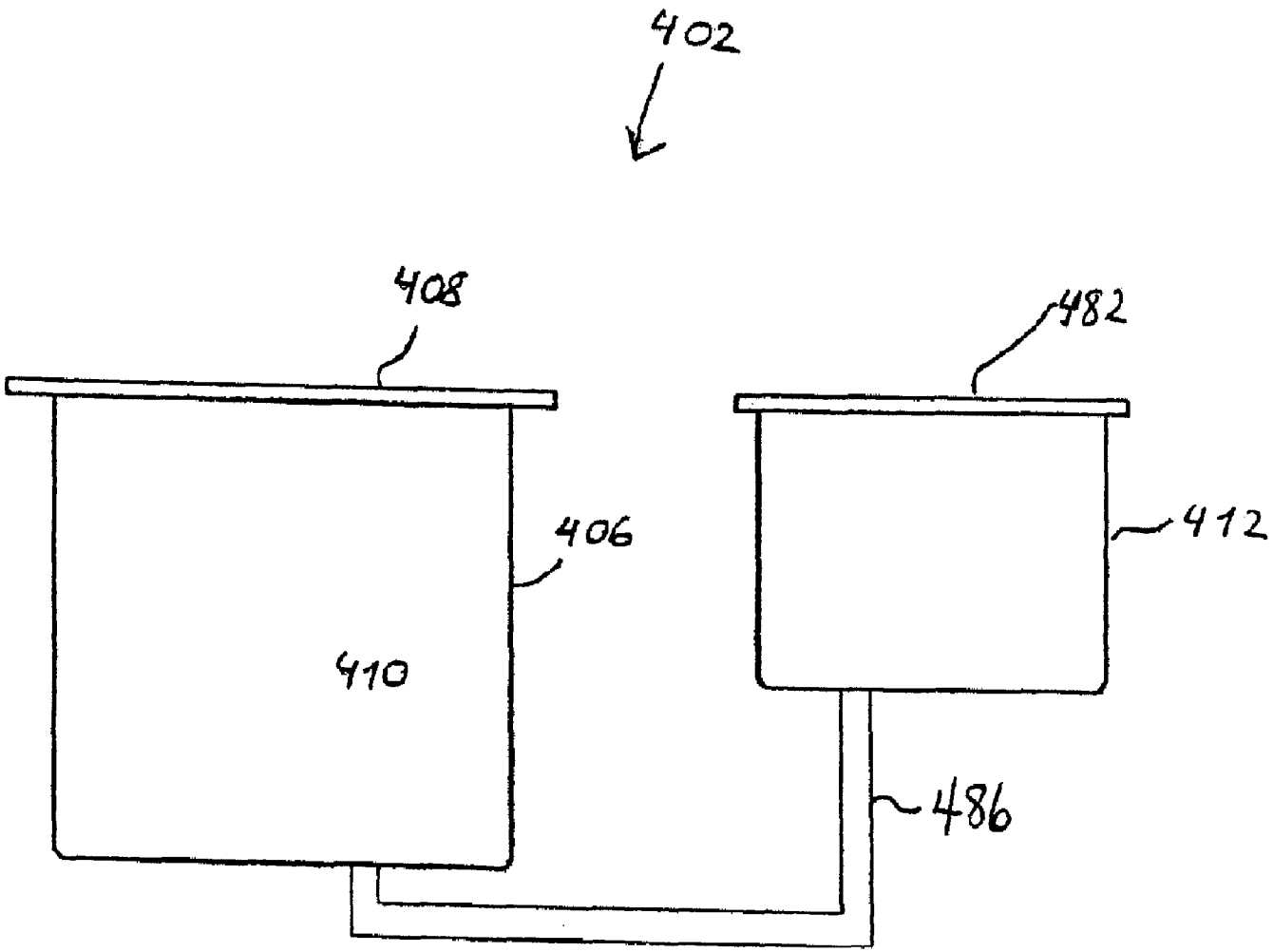
FIG. 6 shows an alternative embodiment of the invention.

FIG. 6 shows an alternative embodiment 402 showing a first section of a housing 406, which comprises an upper glass 408 and a lamp housing 410. Besides this, the second section of the housing 412 is shown having an upper closure 482 which is removable from the outside where cables 486 are connecting the first section of the housing 406 and the second section of the housing 412.

Placing the two housing sections side by side leads to a reduced total height of the apparatus, and furthermore it also allows service access for the second section of the housing 412 by opening the closure 482 for service and maintenance in the second section 412. Especially, if the apparatus 402 is used indoors placed under a floor, the reduced height of the apparatus is necessary because there is a maximum allowable distance where you can hide the lamp housing under a floor without penetrating the ceiling totally.

What is claimed is:

1. Apparatus for illumination, comprising:

at least one housing suited for in ground use, said housing containing at least one lamp which is surrounded by a reflector, a light changer, and control means for controlling the at least one lamp and the light changer;

wherein the light changer comprises means for at least one of panning and tilting the light beam;

wherein the light changer comprises at least changeable means for forming the light beam;

wherein the light changer comprises means for changing the color of the light beam; and wherein the housing has an outer casing formed with at least one opening which is covered by a diaphragm which is moisture permeable in an outward direction for transmission of moisture from the inside of the housing to the outside, but which is water tight in a direction from the outside to the inside.

2. Apparatus according to claim 1, wherein the at least one opening in the casing is located in a lower part of the casing and is directed downwards.

3. Apparatus according to claim 1, wherein the opening in the casing is located in a lower part of the casing in a vertical direction.

4. Apparatus according to claim 1, wherein the apparatus is divided into a first section and a second section, the first section containing a lamp chamber, and the second section containing power and data connections and at least one of electric power components and control circuits of the control means and servo motors.

5. Apparatus according to claim 4, wherein the first section of the housing comprises a lamp chamber having a bottom wall, wherein the second section of the housing is located below said bottom wall and contains a number of separate chambers, wherein a first said separate chambers contains said electronic power components, where a smaller second of said separate chambers contains control circuits for controlling servo motors adapted for adjustment of at least one of the shape, color, pan, and angle of inclination of the light beam, wherein a third of said separate chambers contains said power connections, and wherein a fourth of said separate chambers contains said data connections.

6. Apparatus according to claim 5, wherein the lamp chamber and the first and the second of said separate chambers are open to a flow of air, and wherein the lamp chamber is sealed relative to the third and the fourth of said separate chambers.

7. Apparatus according to claim 5, wherein the first and second of said separate chambers are separated by a cut through which is open downwards to the surroundings which is open towards the bottom wall of the lamp chamber, and wherein the bottom wall of the lamp chamber has an opening that is covered by said diaphragm in an area above the cut through.

8. Apparatus according to claim 7, wherein the diaphragm is positioned in a diaphragm holder, and wherein the diaphragm holder is replaceably positioned in an opening in the bottom wall of the lamp chamber.

9. Apparatus according to claim 4, wherein the first and second sections are separated, where the second section is located beside the first section for providing access between the first and second section, and where cables connect the first and the second section.

10. Method for preventing moisture build-up inside an illumination apparatus, which apparatus contains at least one lamp that is surrounded by a reflector means, a light changer, and a control means for controlling at least the lamp and the light changer, which light changer comprises means for at least panning and tilting the light beam, which light changer comprises at least changeable means for forming the light beam, wherein the light changer comprises means for changing the color of the light beam, the method comprising using a permeable means for transmitting moisture from inside of the apparatus to the outside and for transmission of dry air from the outside to the inside.

* * * * *